US006607240B2

(12) United States Patent
Zheng

(10) Patent No.: US 6,607,240 B2
(45) Date of Patent: Aug. 19, 2003

(54) COLLAPSIBLE CHAIR WITH SOLID ARM REST AND TENSIONED SEAT

(76) Inventor: Edward Zheng, 876 Everest Dr., Chino Hills, CA (US) 91709

( * ) Notice: Subject to any disclaimer, the term of this patent is extended or adjusted under 35 U.S.C. 154(b) by 0 days.

(21) Appl. No.: 10/025,361

(22) Filed: Dec. 19, 2001

(65) Prior Publication Data

US 2003/0111872 A1 Jun. 19, 2003

(51) Int. Cl.[7] ..... A47C 4/44
(52) U.S. Cl. ..... 297/16.2; 297/39; 297/45
(58) Field of Search ..... 297/16.2, 45, 35, 297/39

(56) References Cited

U.S. PATENT DOCUMENTS 4,386,790 A * 6/1983 Kassai ..... 297/45
6,364,409 B1 * 4/2002 Saul et al. ..... 297/16.2
6,454,348 B1 * 9/2002 Wu ..... 297/16.2

FOREIGN PATENT DOCUMENTS

EP 52031 * 5/1982 ..... 297/16.2
FR 1110223 * 2/1956 ..... 297/45

* cited by examiner

*Primary Examiner*—Peter R. Brown
(74) *Attorney, Agent, or Firm*—Rutch & Tucker LLP; Robert D. Fish

(57) ABSTRACT

A collapsible chair front and rear leg, seat and back support rods, first and second pairs of cross braces, and solid arm rest, all of which are coupled such that the chair collapses in a single movement in which the front legs approximate each other when the seat support rods pivots towards the back support rods. The seat in preferred chairs is a tensioned seat and continuous with the backrest.

18 Claims, 2 Drawing Sheets

FIG. 1A
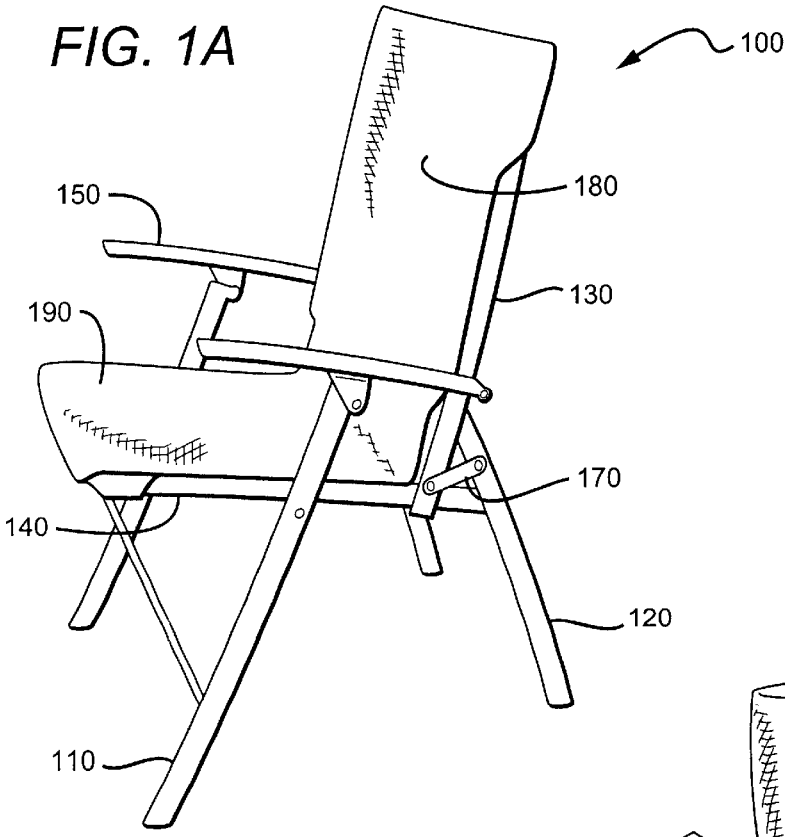
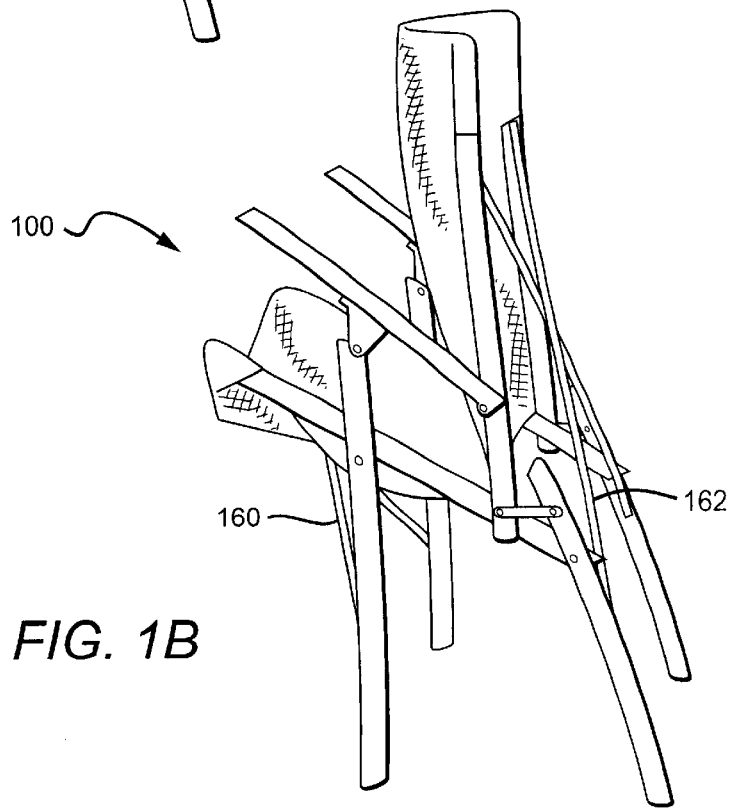
FIG. 1B

COLLAPSIBLE CHAIR WITH SOLID ARM REST AND TENSIONED SEAT

FIELD OF THE INVENTION

The field of the invention is collapsible furniture.

BACKGROUND OF THE INVENTION

Folding chairs are relatively popular, in part because they can be stored at considerably reduced space requirements when compared to non-folding chairs. Exemplary folding chairs with solid arm rests and seat support rods are described in U.S. Pat. No. 4,613,185 to Marchesini et al. (Sep. 23, 1986), U.S. Pat. No. 5,899,525 to Tseng (May 4, 1999), U.S. Pat. No. 5,947,553 to Tseng (Sep. 7, 1999), and U.S. Pat. No. 6,062,639 to Hill (May 16, 2000), all of which are incorporated by reference herein.

Nevertheless, previously known folding chairs still take up a relatively large space when folded, since the dimension of the folding chair is generally reduced only along one space coordinate (e.g., reduced length). To further reduce the space requirement, collapsible chairs have been developed in which further size reduction is achieved by folding the chair along at least two space coordinates (e.g., length and width). Various collapsing chairs are known in the art.

For example, Sparkes describes in U.S. Pat. No. Des 247,618 (Mar. 28, 1978) a collapsible stroller with solid armrests and seat support rods that is first folded in a front to back motion and then folded in a side-to-side motion. Although Sparkes' stroller provides substantial space saving over non-collapsible strollers, the collapsing is relatively cumbersome since both halves of the chair have to be rotated relative to each other. Improved collapsibility can be achieved by including a detachable connector element into a structure that couples foldable halves of the stroller as described in U.S. Pat. No. 4,317,581 to Kassai (Mar. 2, 1982). Uncoupling of the detachable element advantageously simplifies side-to-side folding of the stroller. However, Kassai's stroller nevertheless requires at least two folding operations to collapse the stroller.

To avoid at least some of the problems associated with multiple operations of collapsible chairs, Mann describes in U.S. Pat. No. 5,058,950 (Oct. 22, 1991) the use of hinges in both armrests and seat support rods. Mann's chair can be collapsed in a single side-to-side and front-to-back motion, however, the hinges in the armrests may be uncomfortable for at least some of the users. Moreover, due to the particular configuration of movable elements in the chair, front and back seat support rods are perpendicular to the legs of a person sitting in the chair, which will likely restrict blood flow in the legs of almost all users over a prolonged period.

Although there are various collapsible chairs with solid armrests known in the art, all or almost all of them suffer from one or more disadvantages. Therefore, there is a need to provide improved methods and apparatus for collapsible chairs with solid armrests.

SUMMARY OF THE INVENTION

The present invention is directed to a collapsible chair that can be collapsed in a single motion, wherein the chair includes solid arm rests and a (preferably) tensioned seat coupled to a pair of seat support rods. In particular, the collapsible chair has a pair of front legs, a pair of rear legs, a pair of back support rods, a pair of seat support rods, and a pair of solid arm rests. Contemplated chairs further comprise a first pair of cross braces that couple the pair of front legs to the pair of seat support rods, and a second pair of cross braces that couple the pair of rear legs to the pair of back support rods, and at least one of the rear legs is rotatably coupled to at least one of the seat support rods. At least one of the arm rests and at least one of the seat support rods are rotatably coupled to at least one of the back support rods and at least one of the front legs in a manner such that the chair collapses in a single movement in which the front legs approximate each other when the seat support rods pivots towards the back support rods.

In one aspect of the inventive subject matter, at least one of the seat support rods is further rotatably coupled to at least one of the back support rods, and it is further preferred that contemplated chairs further comprise a connector that connects at least one of the rear legs on one side of the chair with at least one of the back support rods at the same side of the chair.

In another aspect of the inventive subject matter, contemplated chairs comprise a backrest coupled to the back support rods, and a seat coupled to the pair of seat support rods, and it is particularly preferred that the backrest is continuous with the seat (preferably a tensioned seat). With respect to the materials it is contemplated that the backrest and/or the seat comprise a weather resistant fabric (e.g., Nylon), and that at least one of the pair of front legs, rear legs, seat support rods, back support rods, and first and second cross braces is manufactured from aluminum.

In a further aspect of the inventive subject matter, a method of imparting collapsibility into a chair comprise one step in which a pair of front legs, a pair of rear legs, a pair of back support rods, a pair of seat support rods, and a pair of solid arm rests are provided. In a further step, the pair of front legs are coupled to the pair of seat support rods with a first cross brace, and the pair of rear legs is coupled to the pair of back support rods via a second cross brace. In a further step, at least one of the arm rests and at least one of the seat support rods are rotatably coupled to at least one of the back support rods and at least one of the front legs in a manner such that the chair collapses in a single movement in which the front legs approximate each other when the seat support rods pivots towards the back support rods.

Various objects, features, aspects and advantages of the present invention will become more apparent from the following detailed description of preferred embodiments of the invention, along with the accompanying drawing, in which like numerals represent like components.

BRIEF DESCRIPTION OF THE DRAWING

FIG. 1A is a perspective view of an exemplary collapsible chair in open configuration.

FIG. 1B is a perspective view of the chair of FIG. 1A in partially collapsed configuration.

DETAILED DESCRIPTION

It is generally contemplated that a collapsible chair with solid armrests includes a seat coupled to a pair of seat support rods, wherein the chair can be collapsed in a single motion. Particularly contemplated chairs have a pair of front legs, a pair of rear legs, a pair of back support rods, a pair of seat support rods, and a pair of solid arm rests, wherein a first pair of cross braces couples the pair of front legs to the pair of seat support rods, and wherein a second pair of cross braces couples the pair of rear legs to the pair of back support rods. In contemplated chairs, at least one of the rear legs is rotatably coupled to at least one of the seat support rods, and at least one of the arm rests and at least one of the seat support rods are rotatably coupled to at least one of the back support rods and at least one of the front legs in a manner such that the chair collapses in a single movement in which the front legs approximate each other when the seat support rods pivots towards the back support rods.

Figure 1C:
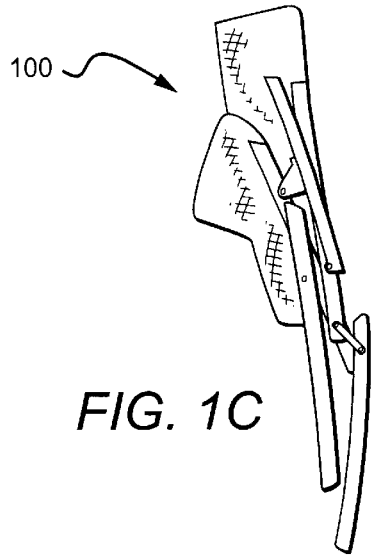
FIG. 1C is a perspective view of the chair of FIG. 1A in collapsed configuration.

In FIG. 1A, a collapsible chair 100 has a pair of front legs 110 (only one front leg has a numeral), a pair of rear legs 120 (only one rear leg has a numeral), a pair of back support rods 130 (only one back support rod has a numeral), and a pair of seat support rods 140 (only one seat support rod has a numeral). A pair of solid armrests 150 (only one armrest has a numeral) is coupled to the chair, which further comprises a backrest 180 and a seat 190. A connector 170 couples the rear leg to the back support rod, while a first pair of cross braces 160 (see FIG. 1B) couples a front leg on one side of the chair to the a seat support rod on the other side of the chair. A second pair of cross braces 162 (see FIG. 1B) couples a rear leg on one side of the chair to a back support rod on the other side of the chair. FIG. 1B depicts the chair 100 in a partially collapsed configuration, and FIG. 1C depicts the same chair 100 in a substantially completely collapsed configuration.

Figure 2:
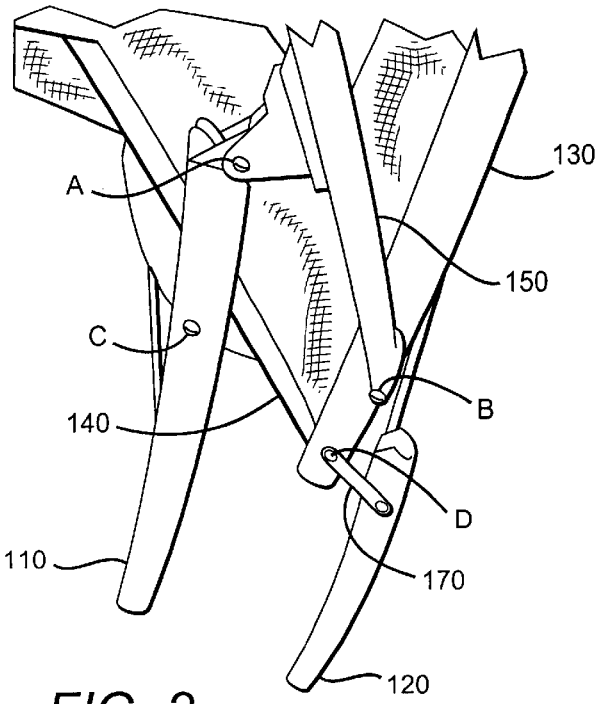
FIG. 2 is a perspective detail view of the chair of FIG. 1A depicting the connector and rotatable couplings between various elements.

In FIG. 2, a perspective detail view of the collapsible chair 100, connector 170 is rotatably coupled to both the rear leg 120 and the back support rod 140, while the rear leg 120 is further rotatably coupled to the seat support rod 140. Armrest 150 is rotatably coupled to front leg 110 at point A and further rotatably coupled to back support rod 130 at point B. Seat support rod 140 is rotatably coupled to front leg 110 at point C and further rotatably coupled to back support rod 130 at point D.

It is contemplated that the seat and the backrest are fabricated from a weather resistant material, preferably a woven synthetic polymer (e.g., Nylon) and is uniformly colored (e.g., blue). Particularly preferred seats have a width of about 21 inches and an overall length of about 24 inches. However, it should be appreciated that various alternative materials, colors, and sizes are also appropriate.

For example, alternative materials may include natural and synthetic fabrics and all reasonable combinations thereof. Contemplated materials may further be woven or non-woven and particularly contemplated materials include polyester, polyvinyl chloride, cotton, hemp, and wool. With respect to the color, it is contemplated that suitable colors need not be restricted to uniform color, but appropriate colors may also include color patterns, prints, or no color at all. While it is generally preferred that the chair according to the inventive subject matter is sized and dimensioned to fit an average adult person, it is also contemplated that appropriate chairs may also accommodate a child, a smaller- or larger-than-average adult, or more than a single person. Therefore, alternative chairs may have dimensions that are wider than 21 inches, and suitable widths include 21–24, 24–30, and 30–40 inches, and wider, but also 18–21, 14–18, and 8–14 inches, and narrower. Likewise, the length of appropriate seats may vary between 20–42, 15–10, and 12–15 inches and less, but also between 24–27, 27–30, and more. It should further be appreciated that contemplated seats may also be tapered from the front end to the back end, or vice versa.

With respect to the backrest it is contemplated that the backrest is fabricated from the same material as the seat, and that the backrest is removably or permanently coupled to the seat (e.g., sewed, coupled with a zipper, etc.) Thus, it is preferred that the backrest has a width of about 21 inches. A preferred height of the backrest is about 18 inches. With respect to the material and color, it is contemplated that the same considerations as for the seat apply. It is further contemplated that the width and height of suitable backrests may vary, and that width and height will depend among other things on the person's size and the number of persons to be seated in the chair. Thus, alternative backrests may have a width between 18–12 inches and less, but also between 18–22 and more. Similarly, contemplated backrests may have a height between 12–18 inches and less, but also between 18–25 inches and more.

It is generally contemplated that the seat and the backrest may be coupled to the legs and seat support rods in numerous ways, including temporary and permanent coupling. Temporary couplings include hook-and-loop type fasteners, snaps, buckles, slidable elements (e.g., a pouch slidably coupled to a post, a ring slidably coupled to a rod, etc.), and threadably securable elements (e.g., laces threaded through rings). Permanent couplings include sewed or glued elements. For example, the backrest may permanently coupled to the chair via a rivet. On the other hand, the front end of the seat may be temporarily coupled to the front legs via ring-shaped openings slided over the top ends of the front legs. It is further, particularly preferred that the seat and the backrest are coupled together.

It should further be appreciated that the attachment of the seat and/or the backrest to the chair may be directly or indirectly attached. As used herein, the term "direct" attachment means that the seat and/or the backrest are in immediate contact with the supporting structure, whereas the term "indirect" means that an additional element connects the seat and/or backrest with the supporting structure. For example, the seat may be directly attached to the seat support rods via a slidable pouch. Alternatively, the seat may be indirectly coupled to the seat support rods via a ring-shaped opening in the seat that slidably engages with the rods.

With respect to the legs, seat support rods, and cross braces of contemplated chairs, it should be appreciated that all of these elements may be manufactured from various materials, including metals, metal alloys, natural and synthetic polymers, and any reasonable combination thereof. However, it is preferred that the legs, seat support rods, and cross braces are manufactured from black anodized aluminum tubing with a wall strength of about 1/32 inch and an outer diameter of approximately ½ inch. Preferred alternative materials include stainless steel, fiberglass, and wood.

It is further preferred that the solid armrest is fabricated from a recycled molded thermoplastic polymer, and especially preferred alternative materials for the armrest, legs, support rods, and cross braces include stainless steel, fiberglass, and wood. As used herein, the term "solid armrest" means that the armrest is fabricated from a sufficiently stiff material to maintain the shape of the armrest while the chair is being folded or unfolded. For example, a wooden or metal armrest is considered a solid armrest under the scope of this definition, because such armrests are fabricated from a material with sufficient stiffness to maintain the shape of the armrest. In contrast, a woven or textile armrest, is not considered a solid armrest under the scope of this definition because such armrests will deform (i.e. change their shape) while the chair is folded or unfolded.

Where one of the legs, back support rods, seat support rods, armrests, and cross braces is rotatably, pivotally, or slidably coupled to another one of the legs, back support rods, seat support rods, armrests, and cross braces, it is generally contemplated that all known manners of rotatably/pivotally coupling are suitable for use in conjunction with the teachings presented herein. For example, appropriate manners of rotatably/pivotally coupling include coupling of two elements via a common axis, coupling via a hinge wherein the hinge may or may not have a slidable connection to another element, coupling via a ball bearing, etc. Similarly, where one of the legs, back support rods, seat support rods, armrests, and cross braces is slidably coupled to another one of the legs, seat support rods, and cross braces, all known slidable couplings are contemplated to be appropriate, and include a sliding sleeve, slide rails, guiding rings, etc.

In a preferred aspect, a collapsible chair has a pair of front legs, a pair of rear legs, a pair of back support rods, a pair of seat support rods, and a pair of solid arm rests, wherein a first pair of cross braces couple the pair of front legs to the pair of seat support rods, and a second pair of cross braces couple the pair of rear legs to the pair of back support rods. At least one of the rear legs is rotatably coupled to at least one of the seat support rods, and at least one of the arm rests and at least one of the seat support rods are rotatably coupled to at least one of the back support rods and at least one of the front legs in a manner such that the chair collapses in a single movement in which the front legs approximate each other when the seat support rods pivots towards the back support rods. The top portion of each of the rear legs preferably comprises a receiving element that securely engages with the back supporting rod when the chair supports a person or is in an open configuration, and that disengages from the back supporting rod when the chair is collapsed from the open configuration into the collapsed configuration.

In further preferred aspects, at least one of the seat support rods is further rotatably coupled to at least one of the back support rods, and contemplated chairs may further comprise a connector that connects at least one of the rear legs on one side of the chair with at least one of the back support rods at the same side of the chair.

It is generally preferred that all of the couplings in contemplated chairs allow rotating and/or pivoting movement between the coupled elements, and it is particularly preferred that the armrest, seat support rod, back support rod and front leg are coupled such that they form a square or trapezoid. However, in alternative aspects, at least one of the couplings may also be a slidable or telescoping coupling that may enable, for example, a reclining backrest. Furthermore, various alternative couplings between the legs, the seat support rods, the back support rods, and the arm rests are also suitable, so long as such couplings still allow the chair to be collapsed in a single motion in which the front legs approximate when the seat supporting rods pivot towards the back supporting rods.

It is further generally contemplated that the first and second pair of cross braces couple the opposing sides (i.e., the left side and the right side of the chair as viewed from a person siting in the chair) of the chairs in a manner well known from a quad chair. For example, the first pair of cross braces will typically comprise two rods that are rotatably coupled to each other around a common axis, wherein the one end of the first rod is rotatably coupled to the seat supporting rod on one side of the chair and the other end rotatably coupled to the front leg on the other side of the chair (the second rod having a corresponding configuration). Similarly, the second first pair of cross braces will typically comprise two rods that are rotatably coupled to each other around a common axis, wherein the one end of the first rod is rotatably coupled to the back supporting rod on one side of the chair and the other end rotatably coupled to the rear leg on the other side of the chair (the second rod having a corresponding configuration).

Figure 3:
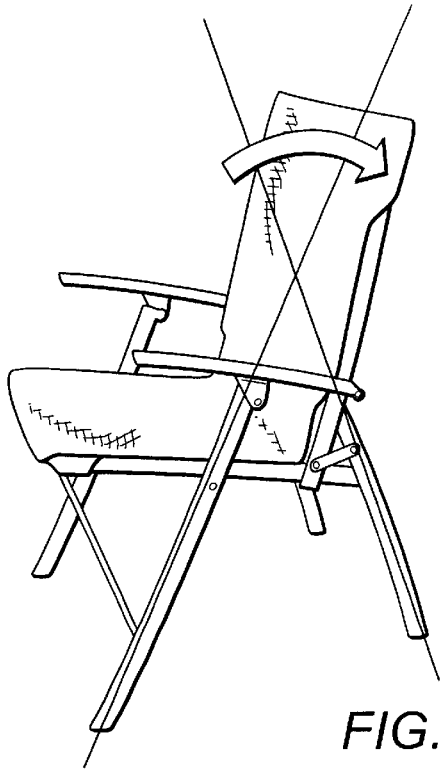
FIG. 3 is a perspective view of the chair of FIG. 1A depicting the common axis of rotation of the front and rear legs around each other.

With respect to the rear legs, it is generally preferred that the rear legs are rotatably coupled to at least one of the seat support rod and the back support rod. However, it is preferred that the rear legs are further coupled via a connector to the back support rod. Consequently, contemplated chairs include those, which form a virtual quad configuration. The term "virtual quad" as used herein refers to a chair comprising a first and a second pair of cross braces coupling the opposing sides of the chair, and in which the front and rear legs form a cross brace having a common axis of rotation (around each other) outside of the front and rear legs as depicted in FIG. 3.

Thus, a method of imparting collapsibility into a chair has one step in which a pair of front legs, a pair of rear legs, a pair of back support rods, a pair of seat support rods, and a pair of solid arm rests are provided. In another step, the pair of front legs is coupled with the pair of seat support rods via a first cross brace, and the pair of rear legs is coupled to the pair of back support rods via a second cross brace. In a further step, at least one of the rear legs is rotatably coupled to at least one of the seat support rods, and in a still further step, at least one of the arm rests and at least one of the seat support rods are rotatably coupled to at least one of the back support rods and at least one of the front legs in a manner such that the chair collapses in a single movement in which the front legs approximate each other when the seat support rods pivots towards the back support rods.

It should be recognized that such preferred coupling may be realized in various configurations. In an exemplary configuration of preferred chairs, the front leg on one side of the chair is coupled to the seat support rod on the other side of the chair via the first cross brace, wherein the cross brace is on one end rotatably coupled to the front leg, and on the other end rotatably (and/or optionally slidably) coupled to the seat support rod. The front leg on the other side of the chair is coupled to the seat support rod on the opposite side of the chair via the first cross brace, wherein the cross brace is on one end rotatably coupled to the front leg, and on the other end rotatably and slidably coupled to the seat support rod. Both of the front legs are rotatably coupled to the respective seat support rods. Each of the seat support rods is further rotatably (and/or optionally slidably) coupled to the back support rods and tear legs. Both of the rear legs are further rotatably coupled to the back support rods via a connector as depicted in FIG. 3. Another set of cross braces (i.e., the second pair of cross braces) couples the back support rods with the rear legs, wherein the coupling between the cross brace and the rear leg is rotatable, and the coupling between the cross brace and the back support rods is rotatable (and optionally slidable). The armrest is preferably rotatably coupled to both the front leg and the back support rod.

However, it should be appreciated that in alternative aspects of the inventive subject matter the number of legs, and/or seat supports may vary considerably. For example, where the chair is sized and dimensioned to accommodate more than one person, three, four, or more legs, and/or seat support rods may be included. On the other hand, where stability of the seat is particularly desirable, three or more seat support rods may be included in a chair with two front legs and two rear legs. Likewise, the number of cross braces may vary, and while some chairs may have only one pair of cross braces, other chairs may include three, four, or more cross braces.

Furthermore, it should be appreciated that the coupling may very depending on the particular configuration of contemplated chairs. For example it is contemplated that all of the couplings may be rotatable and slidable. Alternatively, where slidable couplings are less desirable, alternative couplings may be employed and suitable couplings especially include temporary couplings such as snap connectors, connectors that are secured with a pin or other removable element, etc. In still further alternative aspects of the inventive subject matter, the coupling may be done via a telescoping rod, or an intermediate rod that rotatably couples two elements together (e.g., similar to connector in FIG. 2).

It should be especially appreciated that in preferred configurations of collapsible chairs, the seat is tensioned when the front legs move apart, and that the seat remains substantially tensioned when the seat supports a person. The term "tensioned seat" means that the seat is substantially level when the chair is in the open configuration, wherein the term "substantially level" means that the vertical distance between any point of the seat and the seat support rod is no more than one 0.75 inch, more preferably no more than 0.5 inch, and most preferably no more than 0.25 inch. The term "open configuration" refers to the configuration of the collapsible chair in which the front legs have a maximum distance from each other when the chair is opened using reasonable force (i.e. without damaging the mechanical structure). The term "remains substantially tensioned" means that the vertical distance between the lowest point of the seat and the seat support rod increases no more than one inch, preferably no more than 0.75 inch, more preferably no more than 0.5 inch, and most preferably no more than 0.25 inch. Thus, it should be recognized that the tension of the seat is predominantly determined by the firmness of the material of the seat.

While not whishing to be bound by a particular theory, it is contemplated that the tension in the seat remains substantially tensioned due to mechanically coupling an approximating movement of the seat support rods with a simultaneous pivoting movement the seat support rods towards the back support rods. Viewed from another perspective, it should be recognized that while all or almost all of the prior art chairs with a seat support rod require at least two separate folding operations to collapse the chair, contemplated collapsing chairs are folded in a single movement (comparably to the collapsing of an umbrella). Moreover, it should be recognized that contemplated modes of coupling the front legs with the seat support rods and armrests/back support rods prevent loss of tension of the seat when a person is supported by the chair.

Thus, specific embodiments and applications of collapsible chairs with solid armrests have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A collapsible chair, comprising:

a pair of front legs, a pair of rear legs, a pair of back support rods, a pair of seat support rods, and a distinct solid arm rest;

a first pair of cross braces that couple the pair of front legs to the pair of seat support rods, and a second pair of cross braces that couple the pair of rear legs to the pair of back support rods;

wherein the armrest is (a) at a first position rotatably coupled to at least one of the front legs and (b) at a second position rotatably attached to one of the back support rods;

wherein at least one of the rear legs is rotatably coupled to at least one of the seat support rods; and wherein at least one of the seat support rods is rotatably coupled to at least one of the back support rods and at least one of the front legs in a manner such that the chair collapses in a single movement in which the front legs approximate each other when the seat support rods pivots towards the back support rods.

2. The collapsible chair of claim 1 wherein the other one of the seat support rods is further rotatably coupled to the other one of the back support rods.

3. The collapsible chair of claim 1 further comprising a connector that connects at least one of the rear legs on one side of the chair with at least one of the back support rods at the same side of the chair.

4. The collapsible chair of claim 1 further comprising a backrest coupled to the back support rods, and a seat coupled to the pair of seat support rods.

5. The collapsible chair of claim 4 wherein the backrest is continuous with the seat.

6. The collapsible chair of claim 4 wherein the seat is a tensioned seat.

7. The collapsible chair of claim 4 wherein the backrest comprises a weather resistant fabric.

8. The collapsible chair of claim 7 wherein the backrest comprises Nylon.

9. The collapsible chair of claim 1 wherein at least one of the pair of front legs, rear legs, seat support rods, back support rods, and first and second cross braces is manufactured from aluminum.

10. A method of imparting collapsibility into a chair, comprising:

providing a pair of front legs, a pair of rear legs, a pair of back support rods, a pair of seat support rods, and a distinct solid arm rest;

coupling the pair of front legs with the pair of seat support rods via a first cross brace, and coupling the pair of rear legs to the pair of back support rods via a second cross brace;

rotatably coupling the armrest at a first position to at least one of the front legs, and rotatably attaching the armrest at a second position to one of the back support rods;

rotatably coupling at least one of the rear legs to at least one of the seat support rods; and rotatably coupling at least one of the seat support rods to at least one of the back support rods and at least one of the front legs in a manner such that the chair collapses in a single movement in which the front legs approximate each other when the seat support rods pivots towards the back support rods.

11. The method of claim 10 further comprising rotatably coupling the other one of the seat support rods to the other one of the back support rods.

12. The method of claim 10 further comprising connecting at least one of the rear legs on one side of the chair with at least one of the back support rods at the same side of the chair with a connector.

13. The method of claim 10 further comprising coupling a backrest to the back support rods, and coupling a seat coupled to the pair of seat support rods.

14. The method of claim 13 wherein the backrest is continuous with the seat.

15. The method of claim 13 wherein the seat is a tensioned seat.

16. The method of claim 13 wherein the backrest comprises a weather resistant fabric.

17. The method of claim 16 wherein the backrest comprises Nylon.

18. The method of claim 10 wherein at least one of the pair of front legs is manufactured from aluminum.

* * * * *